US007322765B2

(12) United States Patent
Wang et al.

(10) Patent No.: US 7,322,765 B2
(45) Date of Patent: Jan. 29, 2008

(54) STICK CONTAINER

(75) Inventors: Chun-Te Wang, P.O. Box 44 - 2049, Taipei 10668 (TW); Tsung-Yuan Tu, P.O. Box 44 - 2049, Taipei 10668 (TW)

(73) Assignees: Chun-Te Wang, Hsinchu (TW); Tsung-Yuan Tu, Hsinchu (TW)

( * ) Notice: Subject to any disclaimer, the term of this patent is extended or adjusted under 35 U.S.C. 154(b) by 0 days.

(21) Appl. No.: 11/261,658

(22) Filed: Oct. 31, 2005

(65) Prior Publication Data

US 2007/0177926 A1 Aug. 2, 2007

(51) Int. Cl.
*B43K 21/08* (2006.01)
*B43K 5/06* (2006.01)

(52) U.S. Cl. ..... 401/78; 401/77; 401/75; 401/172

(58) Field of Classification Search ..... 401/75, 401/76, 77, 78, 172, 174
See application file for complete search history.

(56) References Cited

U.S. PATENT DOCUMENTS 2,815,123 A * 12/1957 Safianoff ..... 401/87
3,789,857 A * 2/1974 Ikeda et al. ..... 401/69
5,102,249 A * 4/1992 Holloway et al. ..... 401/78

* cited by examiner

*Primary Examiner*—David J. Walczak
(74) *Attorney, Agent, or Firm*—Mark A. Mersereau; Nikolai & Mersereau, P.A.

(57) ABSTRACT

The stick container includes a cup, a sleeve and a base. The cup includes a placement portion for disposing thereon a lipstick, and a spiral shell pillar extended downward from the cup. The sleeve made of a hollow tube includes a locking portion formed on the bottom portion thereof. The base includes a threaded cylinder formed in the central portion thereof. The threaded cylinder includes a threaded portion corresponding to the spiral shell pillar. A locking portion is formed in the base corresponding to the locking portion of the sleeve. The stick container is structurally simple and easy to assemble, which will largely reduce its fabrication cost.

3 Claims, 6 Drawing Sheets

STICK CONTAINER

BACKGROUND OF THE INVENTION (1) Field of the Invention

The present invention relates generally to a stick container and, more particularly, to a stick container that is structurally simple and easy to assemble, which can largely reduce the fabrication cost.

(2) Description of the Prior Arts

Conventionally, stick containers, such as the containers for lipsticks, are ubiquitous in any lady's bag. Like music in our daily life, the stick containers have a variety of styles, tunes, even colors. However, it is very inconvenient to carry a lipstick without a stick container. Therefore, a well designed stick container is very important for cosmetics purposes.

In general, a current lipstick container includes a base, an inner body member, a cup member, and a spiral shell member. The base and the inner body member are fastened to each other. The inner body member includes a gliding groove formed thereon. The inner wall of the spiral shell member includes a spiral shell guiding trench. The lipstick is disposed on the upper portion of the cup member. The outer wall of the cup member includes a guiding pillar that can move in the gliding groove and the spiral shell guiding trench. In combination, the cup member is disposed in the inner body member allowing the guiding pillar to fall into the gliding groove. The cup member is free to move vertically within the inner body member with a limited range. The spiral shell member is then harnessed outside of the inner body member also allowing the guiding pillar to fall into the spiral shell guiding trench. Finally, the base is assembled to the bottom portion of the inner body body and is affixed thereon. To use the stick container, one can rotate the base. The inner body member is rotated in response to the rotation of the base. The cup member is also rotated in response to the rotation of the guiding pillar. Since the spiral shell member does not move, the cup member can then move upward or downward along the guiding groove driven by the movement of the guiding pillar in the spiral shell guiding trench. The lipstick can then protrude and withdraw within the inner body member. Further, a sleeve made of aluminum or other materials is normally accompanied with the spiral shell member to increase the aesthetic value and the physical strength of the stick container.

Although the conventional stick container described above is easy to use, it involves complicated structure and numerous component parts. The assembly process of the conventional stick container is also too tedious, which renders a higher fabrication cost.

Accordingly, the inventor of the present invention has devoted himself to develop possible solutions for the drawbacks mentioned above. Finally, a new stick container is developed.

SUMMARY OF THE INVENTION

In light of the above, one objective of the present invention is to provide a stick container that is structurally simple and easy to assemble, which can significantly reduce the fabrication cost, so as to solve the problems of the conventional stick container that includes many component parts and structurally complicated.

In order to achieve the above and other objectives, the stick container of the present invention includes a cup, a sleeve and a base.

The cup includes a placement portion for disposing thereon a lipstick, a spiral shell pillar extended downward from the cup, and two symmetrically formed gliding portions.

The sleeve is made of a hollow tube, which includes a gliding groove formed on its side wall corresponding to the gliding portions, and a locking portion formed on its bottom portion.

The base includes a threaded cylinder formed in the central portion of the base. The threaded cylinder includes a threaded portion corresponding to the spiral shell pillar. In addition, a locking portion is formed in the base corresponding to the locking portion of the sleeve.

The cup is inserted in the sleeve. The gliding portion of the cup falls exactly into the gliding groove of the sleeve. The spiral shell pillar of the cup and the threaded cylinder of the base are engaged with each other. Furthermore, the sleeve is securely fastened to the base via the locking portion.

In addition, the position of the gliding portion is higher than that of the bottom portion of the spiral shell pillar. The opening of the threaded cylinder includes a protrusive threaded portion extended inward, which corresponds to the spiral shell pillar.

Accordingly, the stick container of the present invention is advantageous in that the stick container including a cup, a sleeve and a base is structurally simpler than the conventional stick container, and easier to assemble. Consequently, the fabrication cost of the present invention is reduced by 15% to 20%.

DETAILED DESCRIPTION OF THE PREFERRED EMBODIMENTS

The primary features and characteristics of the present invention are described in detail in the following specific embodiments. Any person having ordinary skill in the art would readily understand the technical features and advantages of the present invention. In addition, the present invention can be realized in different particular embodiments. All such modifications and alterations without departing from the spirit of the present invention are considered within the scope of the present invention.

Figure 1:
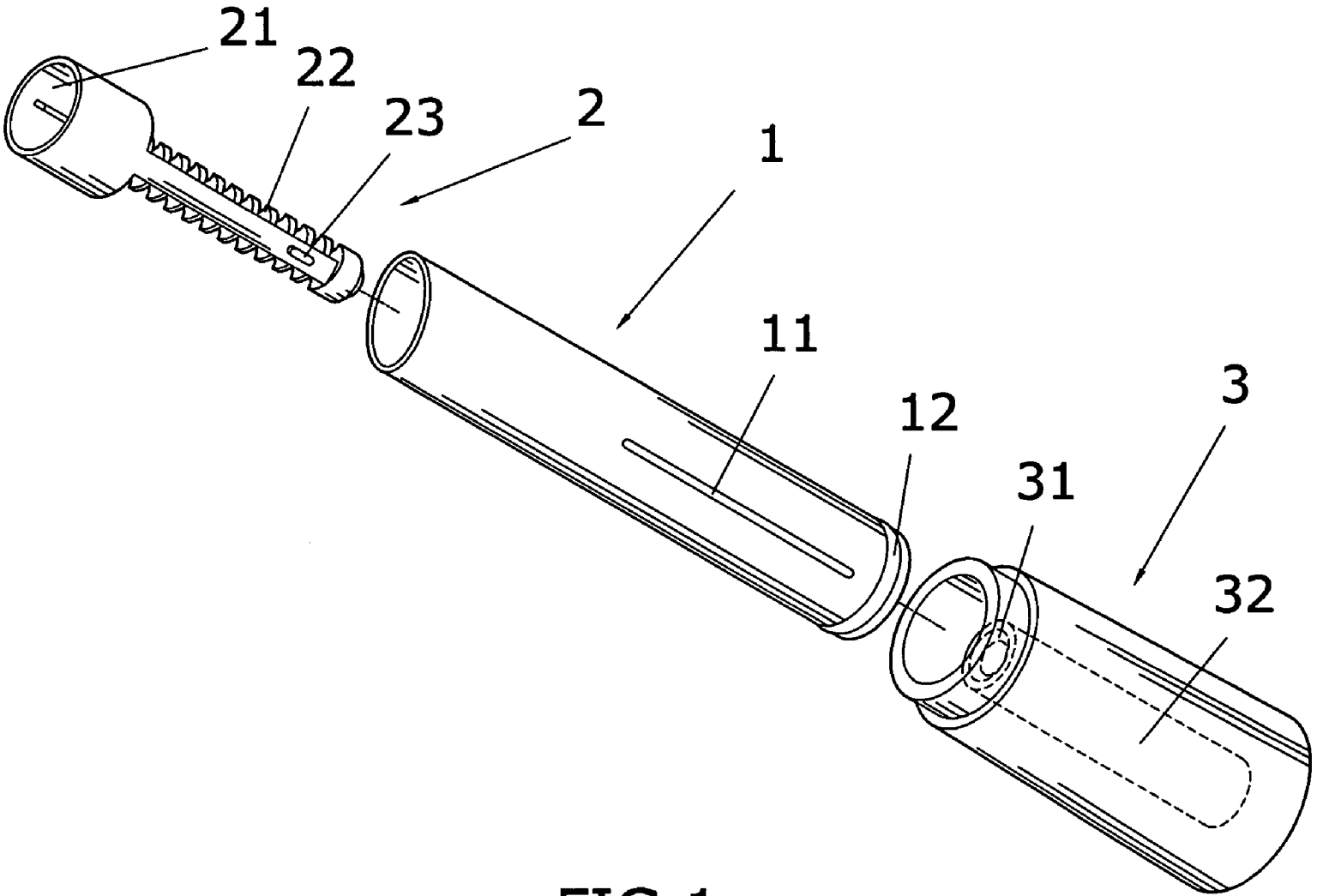
FIG. 1 is an exploded view illustrating a stick container of the present invention.
Figure 2:
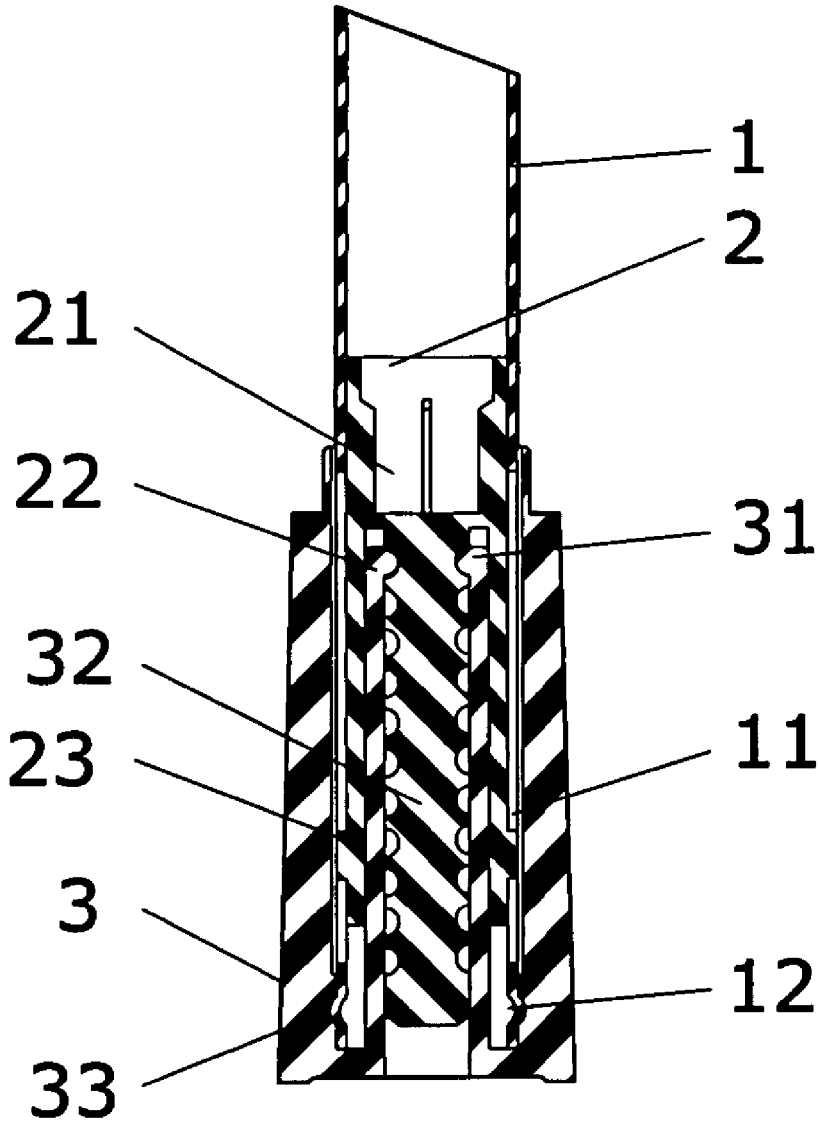
FIG. 2 is a cross sectional view of the stick container, in accordance with one preferred embodiment of the present invention.
Figure 3:
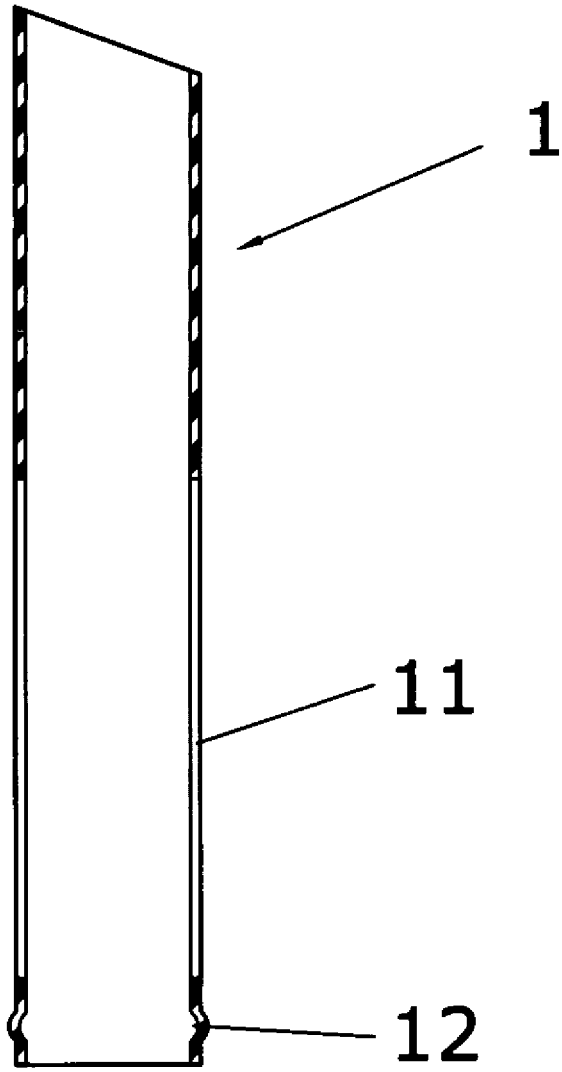
FIG. 3 is a cross sectional view that illustrates the sleeve of the stick container of the present invention.
Figure 4:
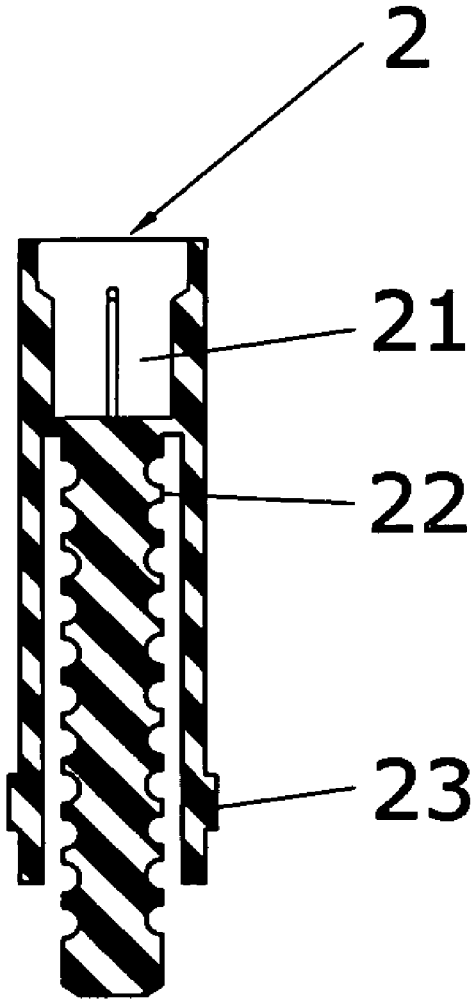
FIG. 4 is a cross sectional view that illustrates the cup of the stick container of the present invention.
Figure 5:
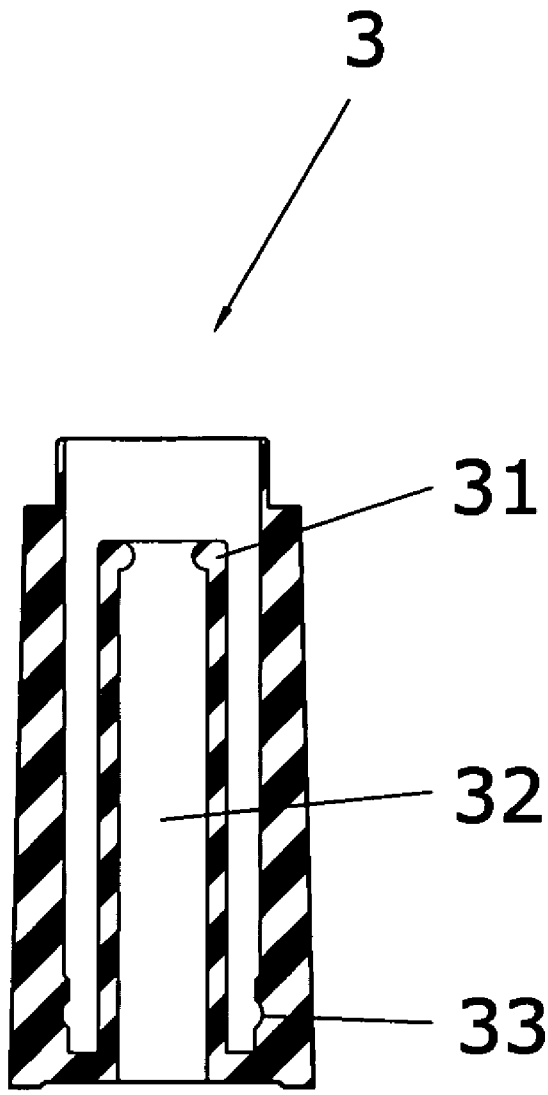
FIG. 5 is a cross sectional view that illustrates the base of the stick container of the present invention.
Figure 6:
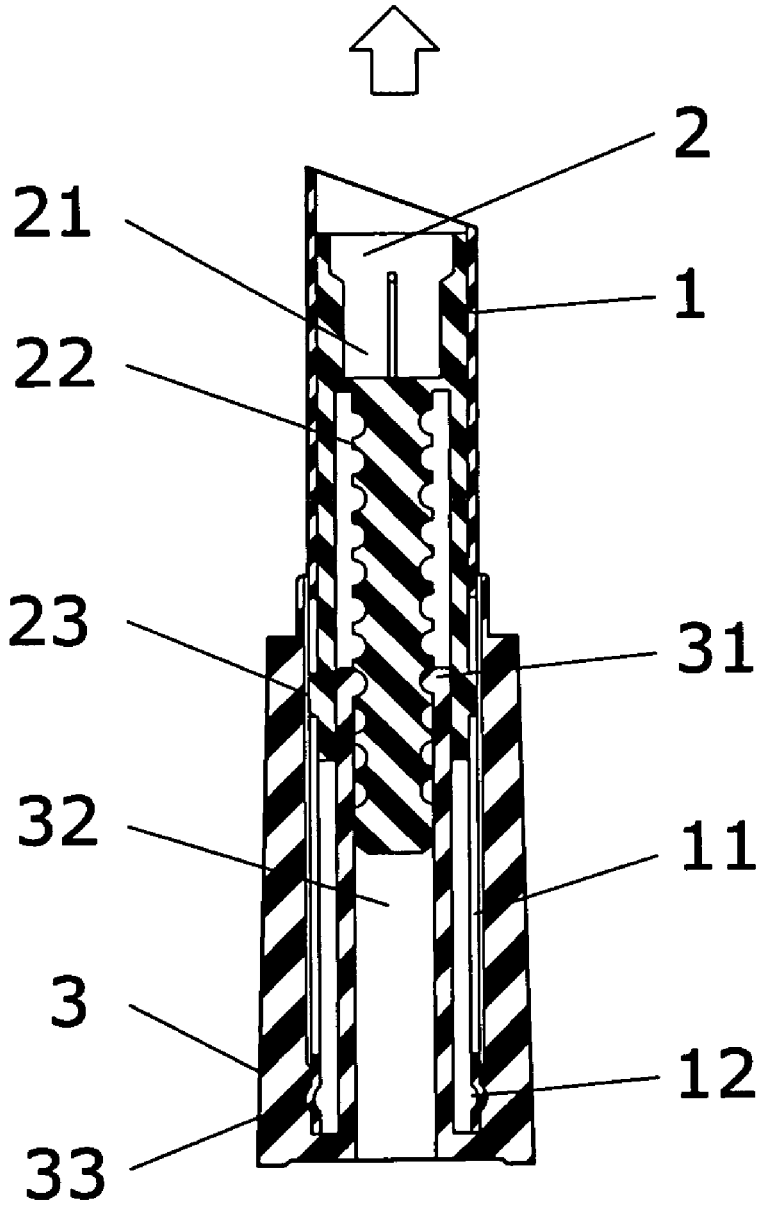
FIG. 6 is a cross sectional view that illustrates the usage of the stick container of the present invention.

Referring to FIG. 1 to FIG. 6, a stick container and the component parts thereof, in accordance with one preferred embodiment of the present invention are illustrated. As shown, the stick container of the present invention includes a cup 2, a sleeve 1 and a base 3.

The cup 2 includes a placement portion 21 for disposing thereon a lipstick. A spiral shell pillar 22 is extended downward from the cup 2. Two sides of the spiral shell pillar 22 includes symmetrically disposed gliding portions 23. For the convenience of assembly, the position of the gliding portions 23 is higher than the bottom portion of the spiral shell pillar 22.

The sleeve 1 is a hollow tube, which is made of aluminum or other materials. The side wall of the sleeve 1 includes a gliding groove 11 corresponding to the gliding portion 23. The bottom portion of the sleeve 1 includes a locking portion 12.

The central portion inside of the base 3 includes a threaded cylinder 32. The threaded cylinder 32 includes a (protrusive) threaded portion 31 corresponding to the spiral shell pillar 22. A locking portion 33 is formed in the base 3 corresponding to the locking portion 12 of the sleeve 1.

The cup 2 is inserted in the sleeve 1. The gliding portion 23 falls exactly in the gliding groove 11. The spiral shell pillar 22 of the cup 2 and the threaded cylinder 32 of the base 3 are engaged with each other. By employing the locking portions 12, 33, the sleeve 1 is securely fastened to the base 3.

When using the stick container, one can rotate the base 3. The sleeve 1 will not move, while the cup 2 will rotate in response to the rotation of the base 3. The cup 2 can move upward or downward within a limited range driven by the threaded pattern. Therefore, the lipstick can protrude or withdraw from the stick container.

In summary, the stick container of the present invention contains less component parts than that of the conventional stick containers. In addition, the stick container of the present invention is structurally simpler and easier to assemble, the fabrication cost of which is thus significantly lower. For these reasons, the stick container of the present invention indeed satisfies the patentability requirements of the patent law, a grant of letters patent is thus respectfully requested.

While the invention has been described by means of specific embodiments, numerous modifications and variations could be made thereto by those skilled in the art without departing from the scope and spirit of the invention set forth in the following claims.

What is claimed is:

1. A stick container, consisting of a cup, a sleeve and a base; wherein the cup includes a placement portion for disposing thereon a lipstick, a spiral shell pillar extended downward from the cup, and two symmetrically formed gliding portions;

the sleeve, made of a hollow tube, includes a gliding groove on the side wall thereof corresponding to one of the gliding portions of the cup, and a locking portion formed on the bottom portion thereof;

the base includes a threaded cylinder formed in the central portion thereof, the threaded cylinder comprising a threaded portion corresponding to the spiral shell pillar, and a locking portion formed in the base corresponding to the locking portion of the sleeve; wherein the cup is inserted in the sleeve, the gliding portion of the cup falling into the gliding groove of the sleeve, the spiral shell pillar of the cup and the threaded cylinder of the base being directly engaged with each other, and the locking portion securely fastened the sleeve in the base.

2. The stick container as recited in claim 1, wherein the position of one of the gliding portions is higher than that of the bottom portion of the spiral shell pillar.

3. The stick container as recited in claim 1, wherein an opening of the threaded cylinder includes a protrusive threaded portion extended inward, which corresponds to the spiral shell pillar.

* * * * *